US006955019B2

(12) United States Patent
Donlin et al.

(10) Patent No.: US 6,955,019 B2
(45) Date of Patent: Oct. 18, 2005

(54) DECORATIVE WALL COVERING WITH UPWARD MOVEMENT PANEL INTERLOCK SYSTEM

(75) Inventors: Terence James Donlin, River Forest, IL (US); Francesco Guzzo, Melrose Park, IL (US)

(73) Assignee: Nailite International, Miami, FL (US)

( * ) Notice: Subject to any disclaimer, the term of this patent is extended or adjusted under 35 U.S.C. 154(b) by 259 days.

(21) Appl. No.: 10/144,284

(22) Filed: May 10, 2002

(65) Prior Publication Data

US 2004/0159062 A1 Aug. 19, 2004

(51) Int. Cl.[7] ..... E04D 1/34

(52) U.S. Cl. ..... 52/520; 52/535; 52/546; 52/555; 52/314; 52/748.1

(58) Field of Search ..... 52/748.1, 314, 52/555, 558, 519, 520, 523, 535, 546, 525, 526, 531, 539

(56) References Cited

U.S. PATENT DOCUMENTS

| | | | | |
|---|---|---|---|---|
| 2,565,607 A | * | 8/1951 | Hall | 52/531 |
| 2,811,118 A | * | 10/1957 | Ball | 52/534 |
| 3,613,326 A | * | 10/1971 | Mollman | 52/314 |
| 4,015,391 A | | 4/1977 | Epstein et al. | |
| 4,223,490 A | | 9/1980 | Medow | |
| 4,308,702 A | * | 1/1982 | Rajewski | 52/519 |
| 4,522,002 A | | 6/1985 | Davis et al. | |
| 4,680,911 A | | 7/1987 | Davis et al. | |
| 5,072,562 A | | 12/1991 | Crick et al. | |
| 5,076,037 A | | 12/1991 | Crick et al. | |
| 5,224,318 A | | 7/1993 | Kemerer | |
| 5,249,402 A | | 10/1993 | Crick et al. | |
| 5,305,570 A | | 4/1994 | Rodriguez et al. | |
| 5,347,784 A | | 9/1994 | Crick et al. | |
| 5,537,792 A | | 7/1996 | Moliere | |
| 5,878,543 A | | 3/1999 | Mowery | |
| 5,956,914 A | | 9/1999 | Williamson | |
| 6,052,961 A | | 4/2000 | Gibbs | |
| 6,269,603 B1 | * | 8/2001 | Ross | 52/520 |
| 6,298,626 B2 | | 10/2001 | Rudden | |
| 6,336,303 B1 | * | 1/2002 | Vandeman et al. | 52/520 |
| 6,421,975 B2 | | 7/2002 | Bryant et al. | |
| 6,715,250 B2 | * | 4/2004 | Bryant et al. | 52/528 |

OTHER PUBLICATIONS

PCT International Search Report for International Application No. PCT/US03/12532 mailed Sep. 11, 2003.

* cited by examiner

*Primary Examiner*—Robert Canfield
(74) *Attorney, Agent, or Firm*—Leydig, Voit & Mayer, Ltd.

(57) ABSTRACT

A wall covering comprising a plurality of plastic panels each having a body portion formed with rows of simulated building elements. The panels are mounted on a support surface with a lower marginal edge region of one panel overlying an upper marginal edge region of a previously mounted panel in a lower course and with a side marginal edge region of one panel overlying the side marginal edge region of a previously mounted adjacent panel in the same course. The marginal edge regions are provided with interlocks which engage and secure both the overlapping upper and lower marginal edge regions and the overlapping side marginal edge regions as an incident to upward movement of the panel relative to the underlying previously mounted panels. In the illustrated embodiment, the overlying lower marginal edge region and side marginal edge region of each panel are formed with upwardly directed locking flanges which are respectively engageable with downwardly directed flanges on the upper marginal edge region and apertures in the side marginal edge region of the underlying panels.

25 Claims, 4 Drawing Sheets

DECORATIVE WALL COVERING WITH UPWARD MOVEMENT PANEL INTERLOCK SYSTEM

FIELD OF THE INVENTION

The present invention relates generally to roof and wall coverings which are primarily intended for outdoor usage, and more particularly, to roof and wall coverings comprised of relatively large panels which each are molded or otherwise formed with decorative patterns characteristic of conventional roofing and siding materials, such as shake shingles, tile, brick or the like.

BACKGROUND OF THE INVENTION

Various synthetic roof and wall coverings are known today which are formed of elongated thermoplastic panels that are nailed to a wall or roof support surface in horizontal courses or rows in partially overlapping relation to each other so as to provide a substantially water resistant, protective layer over the support surface. Such panels, which usually are identically molded, commonly are formed with a plurality of rows of simulated building elements, such as shake shingles. Because the panels are identically molded, a panel-to-panel identity can be easily noticed if the panels are not carefully installed and maintained in secure relation to the support surface. Leakage problems between adjoining panels also can occur.

To facilitate installation, such panels commonly are nailed to the wall or support surface along an upper horizontal nailing flange with the lower marginal edge region overlapping a panel in the course immediately below and with one side marginal edge region overlapping the laterally spaced adjacent panel. It is known to interlock the overlapping lower marginal edge region to the upper marginal edge region of the underlying panel in order maintain the panels in secure relation to each other and the support surface upon which they are mounted. It also is know to interlock the overlying side marginal edge regions in order to prevent bowing of the panels in a vertical direction, and preferably, to interlock the overlying side marginal edge regions adjacent each row of simulated building elements.

Heretofore the provision and use of side interlocks in such simulated building panels has created installation problems. Typically the side interlocks require lateral movement of the panel onto a previously installed panel. On the other hand, to lock the upper and lower marginal edge regions, it is necessary to move the panel vertically upwardly relative to the previously installed panel. Hence, engaging of both the upper, lower, and side interlocks has required cumbersome manipulation of the panel. Moreover, when installing the panels along the bottom of framed windows, dormers, or the like, it is not possible to move the panel both upwardly and laterally during installation. Heretofore, the panel often had to be pried or bent in order to engage the various interlocks, which is difficult and time consuming.

OBJECTS AND SUMMARY OF THE INVENTION

It is an object of the present invention to provide a plastic wall or roof panel having an interlock system adapted for easier and more reliable panel installation.

Another object is to provide a panel as characterized above which has upper, lower, and side marginal edge interlocks that all are engageable as an incident to upward movement of a panel being installed relative to a previously mounted panel.

A further object is to provide a panel of the above kind which includes side interlocks adjacent each row of simulated building elements formed on the panel so as to effect reliable interengagement and prevent bowing along the entire length of the overlapping side marginal edge region.

Still another object is to provide a panel of the foregoing type with interlocks that can be easily engaged even when the panel is installed about window frames, dormers, or the like. A related object is to provide such a panel which has side interlocks that permit, or which are easily adaptable, for interengagement as an incident to either vertical or lateral movement of the panel relative to a previously installed panel.

Yet another object is to provide a panel of the foregoing type which is relatively simple in construction and which lends itself to economical manufacture.

Other objects and advantages of the invention will become apparent upon reading the following detailed description and upon reference to the drawings, in which:

Figures 1, 1A:
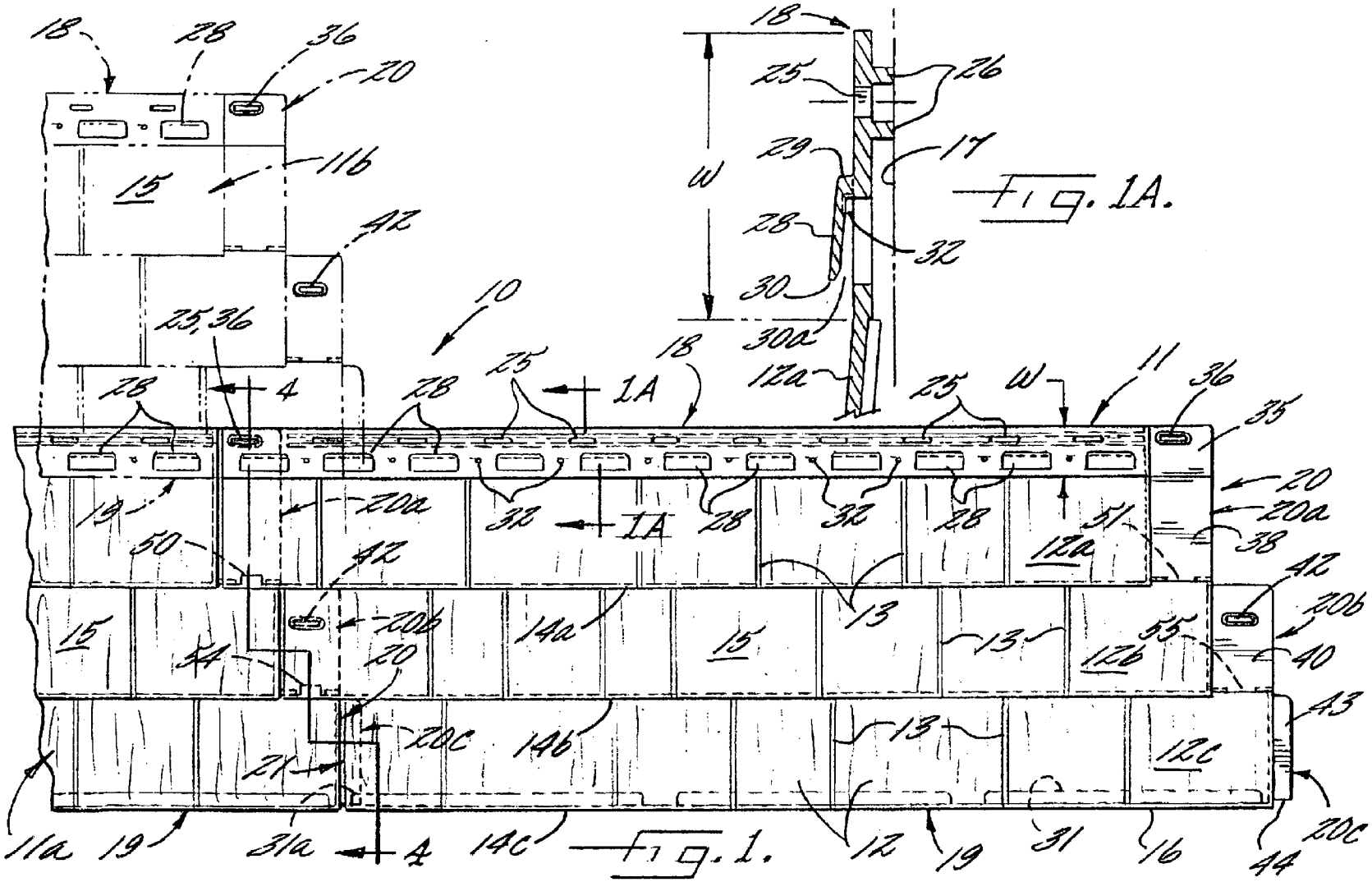
FIG. 1 is a plan view of a portion of a wall covering comprising panels constructed in accordance with the present invention.
FIG. 1A is an enlarged fragmentary section taken in the plane of line 1A—1A in FIG. 1.

While the invention is susceptible of various modification and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF A PREFERRED EMBODIMENT

Referring now more particularly to FIG. 1 of the drawings, there is shown an illustrative wall covering 10 comprising a plurality of panels 11 in accordance with the present invention. The general type of panel employed in the instant invention is described in commonly assigned U.S. Pat. Nos. 5,347,784 and 5,537,792, the disclosures of which are incorporated herein by reference. As shown in FIG. 1, the panels 11 each are formed with simulated building elements. In this instance, the panels 11 are formed with simulated cedar shake 12 of irregular width which are disposed in three parallel rows 12*a*, 12*b*, 12*c* with adjacent shake 12 in each row being separated by a small gap 13. The illustrated simulated shake pattern is of a type known in the industry as "perfection" shake, wherein the lower edges 14*a*, 14*b*, 14*c* of the rows 12*a*, 12*b*, 12*c* are in a substantially straight line, and except for their width, the individual shake elements are substantially similar in appearance.

The simulated shake 12 in this case each have a front face 15 (FIG. 2) extending downwarldy and outwardly at a slight taper to a wall or support surface 17 upon which the panel is mounted and a downwardly directed end face 16 perpendicular to the front face 15. The front face 15 is molded with grooves which simulate the grain of the simulated shake 12, and the end face 16 has the appearance of being in overlapping relation to the upper perimeter of the shake 12 in the underlying row. It will be understood that the panels 11 could be formed with other forms of simulated shake shingles, or other types of building materials, such as tile, brick and the like.

Each panel 11 has an upper horizontal marginal edge region 18 having a substantially uniform width "w" extending across the top of the panel immediately above the top row 12*a* of shake 12, a lower marginal edge region 19 which defines a lower peripheral edge of the panel, a side marginal edge region 20 located to the right-hand side of the last simulated shake 12 in each row 12*a*, 12*b*, 12*c*, and a marginal edge region 21 on the opposite side of the panel 11 defined by a left-side peripheral edge immediately adjacent the first simulated shake of each row 12*a*, 12*b*, 12*c*. The panels 11 are mounted on a support surface 17, which may be a wall or roof of a house or other building structure, in horizontal courses with the right-side marginal edge region 20 in underlying relation to the left-side marginal edge region 21 of the panel immediately to the right thereof and with the lower marginal edge region 19 of the panels in each course overlying the upper marginal edge region 18 of the panel in the previously installed course immediately below.

To enable mounting of the panels 11 in side-by-side relation with the junctures between adjacent panels less noticeable to the eye, the rows 12*a*, 12*b*, 12*c* of shake 12 of each panel 11 extend in offset relation to each other so as to define stepped left and right-hand sides of the panel. In the illustrated embodiment, the second row 12*b* of shake extends farther to the right than the first row 12*a* a distance corresponding to about one-quarter to one-half width of one shake 12 and the last shake of third row 12*c* extends a similar distance beyond the last shake of the second row 12*b*.

Figure 4:
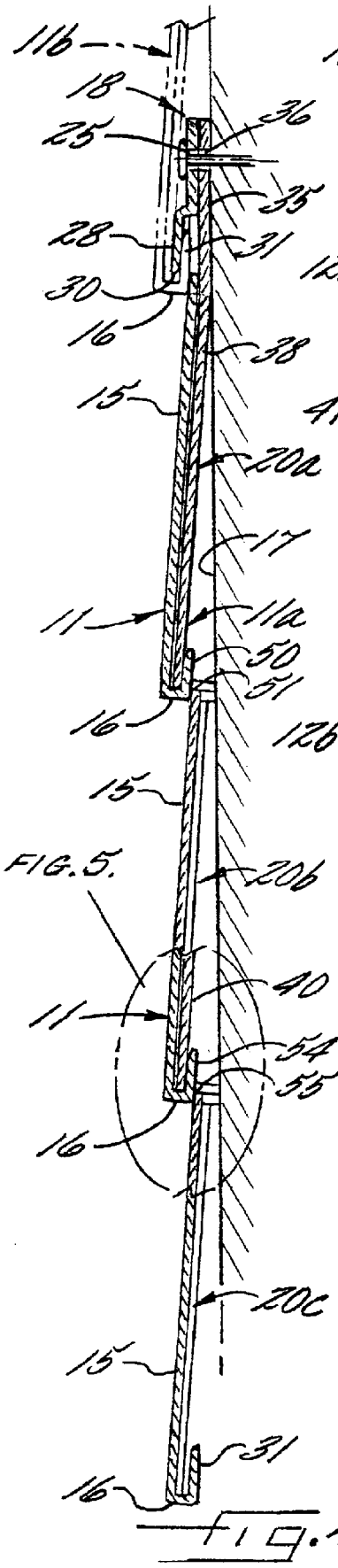
FIG. 4 is an enlarged vertical section taken substantially along the line 4—4 in FIG. 1, showing side interlocks of two mounted panels in engaged relation.

The panels 11 typically are mounted beginning with the left-hand panel of the lowermost course to be installed on the wall or roof, as is known in the art. Upon completion of the first course, the second course is installed, immediately above the first course, again starting from the left-hand side. As is known in the art, the left-hand marginal edge region of the first panel of each row is appropriately cut square with the left side starting edge of the support surface. In the following description, when discussing the interaction of panels disposed in vertically displaced courses, the upper panel will be designated with the reference "11*b*" and the lower or previously mounted panel will be designated with the reference "11*a*" (FIG. 4). This convention is employed in order to clarify the relative positions and order of installation of the subject panels. It will be understood, of course, that despite this nomenclature, the individual panels are substantially identical, and the distinguishing nomenclature is used only to designate positional, not structural, differences.

Figure 3:
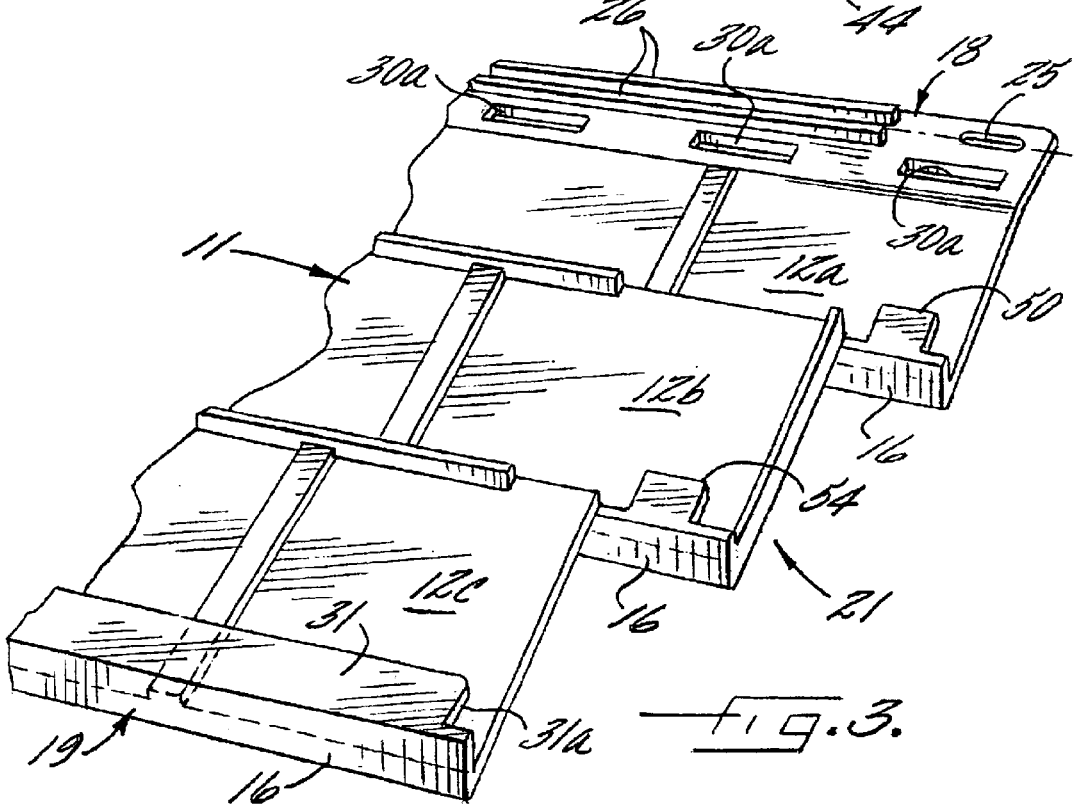
FIG. 3 is an underside perspective of a left-hand side marginal edge region of one of the illustrated panels.

For securing the panels 11 to the support surface 17, the upper marginal edge region 18 of each panel 11 is formed with a row of elongated laterally spaced nailing apertures 25. In order to provide firm support for the panel 11 on the wall during nailing and for establishing a seal between the rear side of the panel 11 and the support surface 17, the upper marginal edge region 18 in this instance is formed with a pair of rearwardly extending horizontal sealing flanges 26 which extend substantially the length of the upper marginal edge region 18 on top and bottom sides of the nailing apertures 25 (FIG. 3). Once the upper marginal edge region 18 is nailed to the support surface, the horizontal sealing flanges 26 are maintained against the support surface 17 subject to relative thermal expansion and contraction.

In order to positively interlock the overlapping lower marginal edge region 19 of a panel 11*b* with an upper marginal edge region 18 of a previously mounted panel 11*a*, each panel 11 is formed with a plurality of laterally spaced forwardly and downwardly directed interlock flanges 28 disposed on the upper marginal edge region 18 between the nailing apertures 25 and the first row 12*a* of building elements. The illustrated interlock flanges 28 have an upper base portion 29 extending outwardly from the upper marginal edge region 18 and a relatively flat locking portion 30 extending downwardly from the upper base portion 29. The relatively flat locking portion 30 is disposed a distance from the forward surface of the upper marginal edge region 18 such that the locking flange 28 and the face of the upper marginal edge region 18 form a slot 30*a*.

The lower marginal edge region 19 of each panel 11 in turn is formed with An upturned interlock flange or lip 31, running substantially the length of the panel 11 and having a thickness corresponding substantially to the width of the slots 30*a* defined by the locking portions 30 of the upper interlock flange 28. The lower interlock lip 31 thus can be positioned under the interlock flanges 28 on the upper marginal region 18 and be moved upwardly into engaged relation with the interlock flange 28. For locating the interlock lip 31 at a predetermined installed position that will accommodate thermal expansion and contraction of the panels in a vertical direction, frangible locating pins 32 extend outwardly of the upper marginal edge region 18 of the underlying panel. It can be seen that the lower interlock lip 31 and upper interlock flanges 28, therefore, can be positioned in predetermined interlocking relation to each other as an incident to vertical movement of a panel 11*b* relative to the previously mounted panel 11*a*.

In accordance with the invention, the side marginal edge regions of the panels are provided with side interlocks which also are adapted for easy and reliable interengagement as an incident to upward vertical movement of the panel relative to a previously mounted underlying panel. To this end, in the illustrated embodiment, the right side marginal edge region 20 of each panel 11 is defined by three laterally offset transverse flange-like segments 20*a*, 20*b*, 20*c* which each is adjacent a respective row 12*a*, 12*b*, 12*c* of the simulated shake. The upper segment 20*a* includes a mounting flange portion 35, formed with a nailing aperture 36, extending parallel, but in recessed relation, to the upper marginal edge region 18, a tapered flange portion 38 having a front face generally parallel, but again in recessed relation, to the front face 15 of the adjacent shake 12*a*, and an end portion 39 which defines a downwardly directed end face generally perpendicular to the tapered front face in recessed relation to the end face 16 of the adjacent shake 12*a*. The middle segment 20*b* has a tapered flange portion 40 with a front face in recessed, parallel relation to the tapered front face 16 of the adjacent shake 12*b* and a downwardly directed end portion 41 parallel to, and in recessed relation, to the end face 16 of the adjacent shake 12*b*. The middle segment 20*b* in this case has a nailing aperture 42 adjacent an upper end thereof. The lower segment 20*c* is in the form of a laterally extending transverse flange 43 having a front face parallel, but again in recessed relation, with respect to the adjacent shake 12*c*, and a lower end 44 recessed from the lower end face 16 of the adjacent shake 12*c*. The flange 43 in this case extends laterally in spaced relation above the support surface 17 upon which the panel 11 is mounted.

In carrying out the invention, the left-side marginal edge region of each panel is provided with interlocks that are engageable with the right-side marginal edge region segments of a previously mounted panel as an incident of vertical movement of the panel relative to the previously mounted underlying panel. In the illustrated embodiment, the underside of the left side marginal edge region 21 of each panel 11 includes a first interlock flange 50 (FIG. 3) extending upwardly from the end face 16 of the first shake 12 of the top row 12*a* for engaging an aperture 51 (FIG. 2) formed in the end portion 39 of the first right-side marginal edge region segment 20*a* It can be seen that as an incident of upward movement of the panel 11 relative to a previously mounted underlying panel, the interlock flange 50 can be inserted into the aperture 51 in underlying relation to the tapered flange portion 38 for positively interlocking the side marginal edge regions adjacent the first row 12*a* of shake. The interlock-receiving aperture 51 preferably has an elongated configuration of a width slightly greater than the width of the interlock flange 50 for allowing horizontal thermal expansion and contraction of the interlocked panels.

In order to provide further interlocking stability between the overlapping side marginal edge regions 20, 21, a second similar interlock flange 54 extends upwardly from the end face 16 of the first shake of the second row 12*b* for engaging a similar elongated aperture 55 formed in the end portion 41 of the second side marginal edge region segment 20*b* for interlocking the side marginal edge regions at a location adjacent the second row 12*a* of shake. For interlocking the side marginal edge regions 20, 21 at a location adjacent the third row 12*c* of shake, a right-hand end portion 31*a* (FIG. 3) of the lower marginal edge region interlock flange or lip 31 is positionable into interlocking relation under a lower peripheral portion 44 of the flange 43 that defines the third side marginal edge region segment 20*c*. It will be understood by one skilled in the art that in lieu of utilizing an end of the lower marginal edge region interlock lip 31, a separate side interlock flange could be provided at the lower marginal edge region of the panel for engaging an aperture in an end face of the third side marginal edge region segment 20*c*, similar to the interlocking arrangement of the first and second side marginal edge region segments.

It can be seen from the foregoing that as an incident to upward movement of one panel relative to previously mounted panels the upper and lower marginal edge interlocks, as well as the side marginal edge interlocks, can be brought into engagement with previously mounted underlying panels. Such interlocking can be easily effected, nearly simultaneously, with simple upward movement of the panel relative to the underlying previously mounted panels. Since the panels are interlocked both along the upper and lower marginal edge regions 18, 19, and at a location adjacent each row of simulated building elements 12*a*, 12*b*, 12*c*, the panels will be securely maintained in engagement with each other and the wall or roof support surface upon which they are mounted.

Figure 5A:
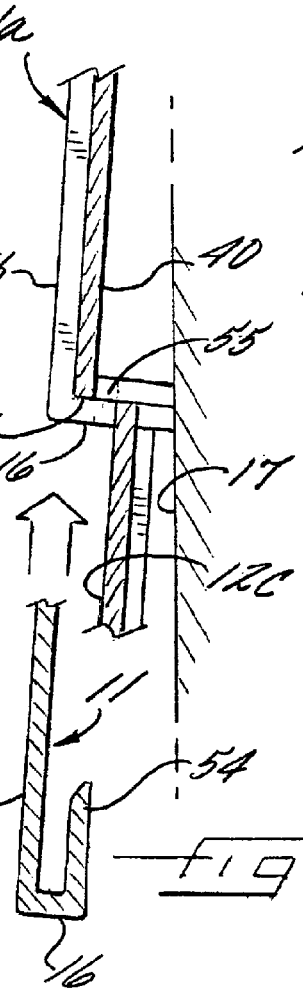
FIG. 5A is an enlarged partially diagrammatic, fragmentary section showing upward movement of a side interlock of one panel into engagement with a previously mounted panel.
Figure 5B:
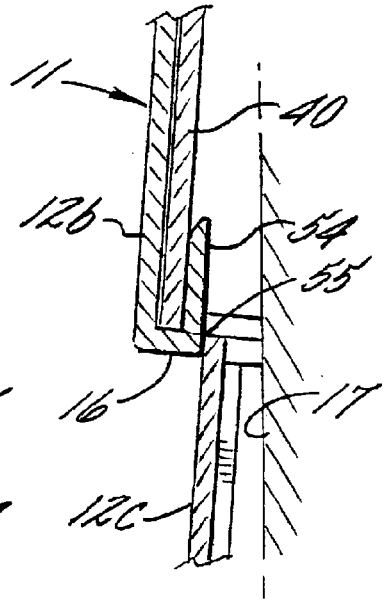
FIG. 5B is a fragmentary section, similar to FIG. 5A, showing the side interlock of the panel in engaged relation with the previously mounted panel.
Figure 6:
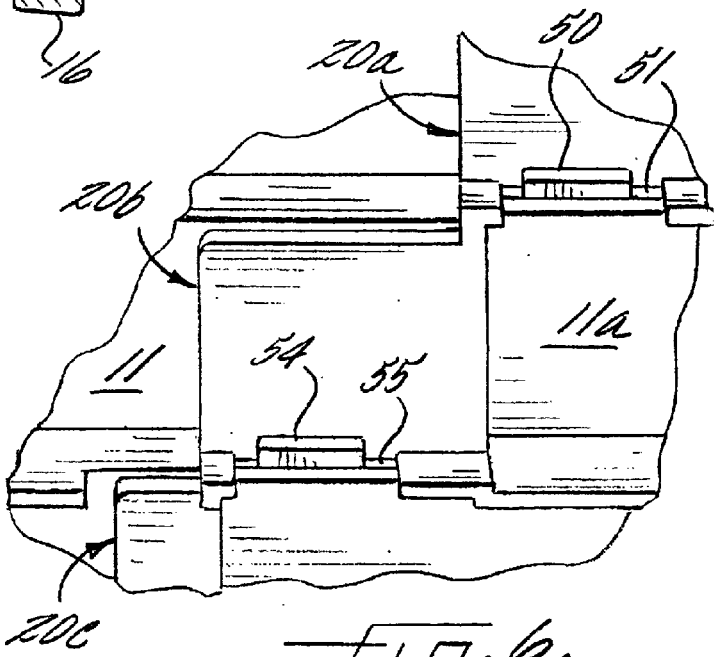
FIG. 6 is a rear fragmentary perspective view of a portion of the illustrated wall covering, showing the engaged side interlocks of two mounted panels.
Figure 7:
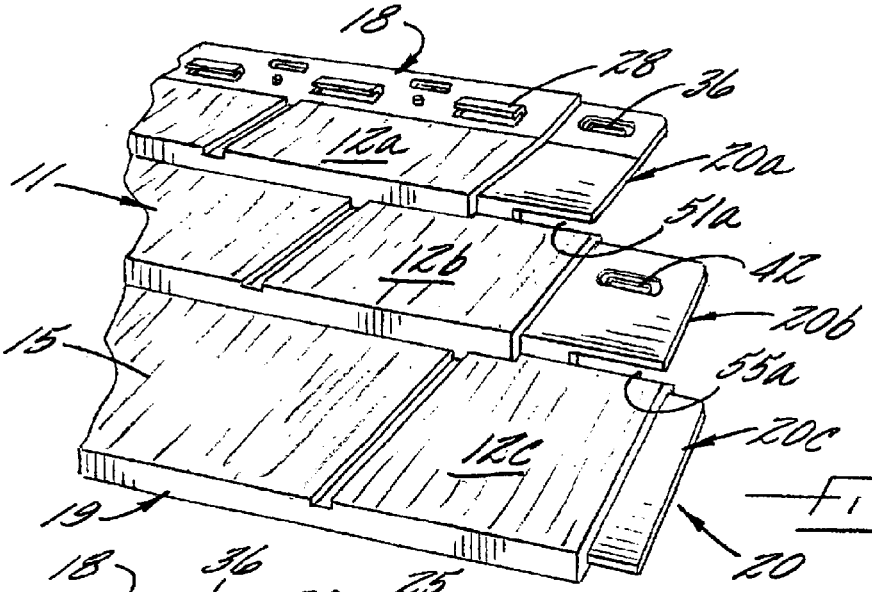
FIG. 7 is a fragmentary perspective of an alternative panel design having side interlocks which are formed, or which are easily modified, to enable engagement of the side marginal edge interlocks as an incident to either vertical or horizontal movement of the panel relative to a previously installed panel.
Figure 8A:
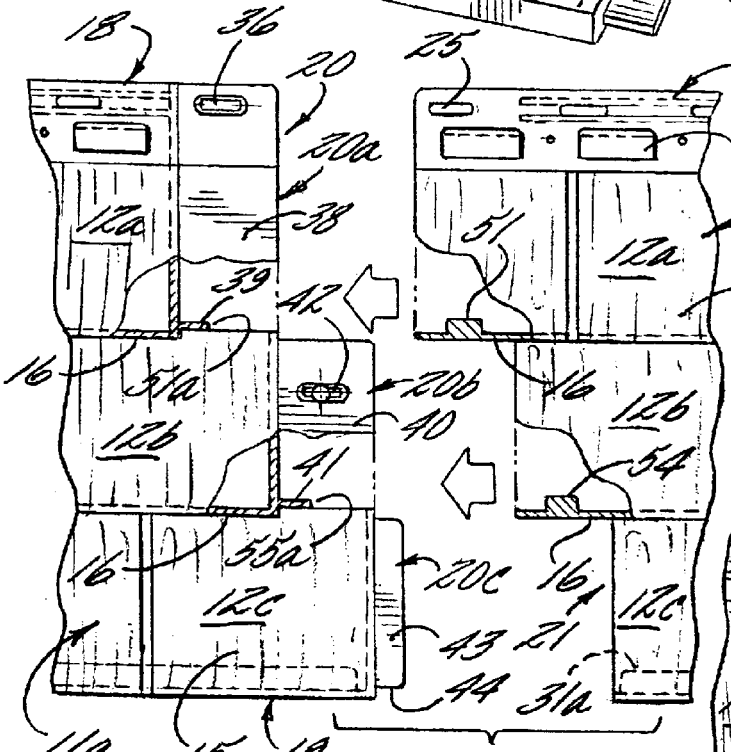
FIG. 8A is a partially diagrammatic depiction showing the panel shown in FIG. 7 being moved into side interlocking engagement with a previously installed panel as an incident to lateral movement.
Figure 8B:
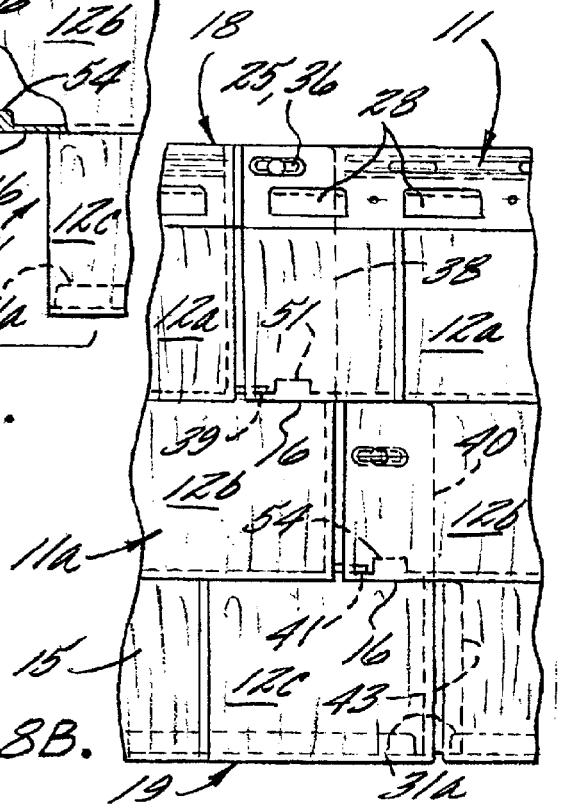
FIG. 8B depicts the panel shown in FIG. 7 in engagement with the previously installed panel.

In accordance with a further aspect of the invention, the panels may have side interlocks which permit, or which are easily adaptable, for enabling interengagement of the side interlocks as an incident to either vertical or lateral movement of the panel relative to a previously installed panel. With reference to FIGS. 7–8, there is a shown a panel 11, similar to that described above, but in which interlock-receiving openings adjacent the ends of the first and second rows 12*a*, 12*b* of simulated shake are defined by side opening slots 51*a*, 55*a*, rather than enclosed apertures. In this embodiment, it will be seen that the side interlock flanges 50, 54 may be inserted into and engage the slots 51*a*, 55*a* as an incident to either vertical movement of a panel relatively to the previously installed panel, in a manner similar to that depicted in FIGS. 5A and 5B, with the interlock flange moving upwardly into the slots 51*a*, 55*a*, or alternatively, the side interlock flanges 50, 54 may be inserted into and engage the slots 51*a*, 55*a* as an incident to lateral movement of a panel relative to a previously mounted panel with the interlock flanges 50, 54 moving laterally into the side opening slots 51*a*, 55*a* from the open right-hand side thereof, as depicted in FIGS. 8A and 8B. The lower lip portion 31A similarly may be brought into interlocking relation with the flange 43 of lower side marginal edge segment 20*c* as an incident to either vertical or lateral movement. It will be appreciated by one skilled in the art that such modified panel design is particularly adaptable for mounting around window frames, dormers, and other corner areas, in which movement of the panel may be restricted or impeded during mounting. The side interlocks in this case can be easily engaged in such case by either lateral or vertical movement of the panel being installed without prying or cumbersome manipulation of the panel typical of the prior art.

Figure 2:
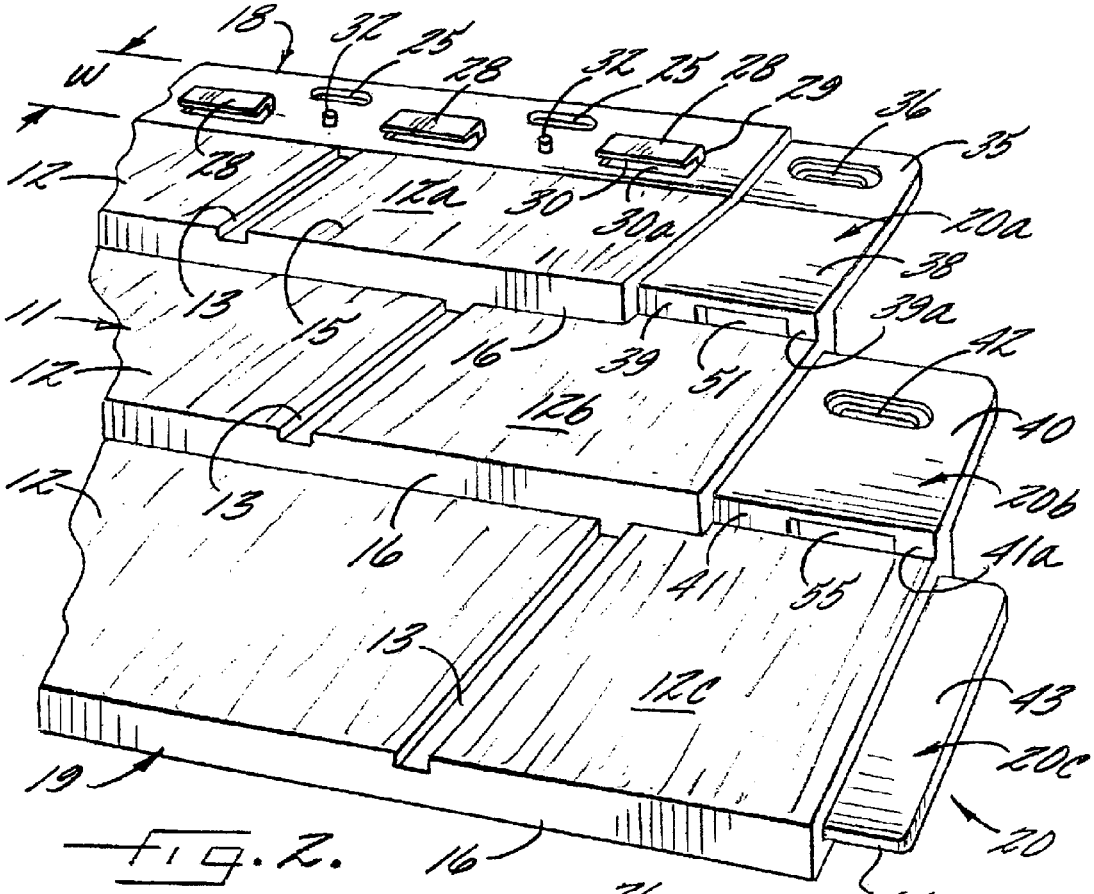
FIG. 2 is a front fragmentary perspective of a right-hand side marginal edge region of one of the panels of the wall covering shown in FIG. 1.

In keeping with the invention, the side opening interlock slots 51*a*, 55*a* may be formed during original molding of the panel 11, or alternatively, a small segment of the side marginal edge region end portions 39, 41, designated 39*a*, 41*a* in FIG. 2, may be cut away or otherwise removed from the panel in the field, such as by use of a utility knife, to open the end of the slot for enabling the side interlock flanges to enter as an incident to lateral panel movement. During normal mounting, i.e., as an incident to vertical panel movement, the apertures 51, 55 would remain intact.

From the foregoing, it can be seen that a plastic wall or roof panel of the present invention has a marginal edge region interlock system adapted for easier and more reliable panel installation. Specifically, the panels have upper, lower, and side marginal edge interlocks that all are engageable as an incident to upper movement of a panel being installed relative to a previously mounted underlying panel. The panels further may have side interlocks that permit, or are easily adaptable, for interengagement as an incident to either vertical or lateral movement of the panel relative to a previously installed panel. Yet, the panels have a relatively simple construction which lends itself to economical manufacture.

What is claimed is:

1. A wall covering for mounting on a support surface comprising:

a plurality of panels each having a body portion formed with simulated building elements; said panels each having upper and lower marginal edge regions and first and second side marginal edge regions;

said panels being mountable on said support surface in a plurality of horizontal courses with at least some of said panels in a first horizontal course having a lower marginal edge region overlying an upper marginal edge region of a previously mounted panel in a second course positioned below the first horizontal course and with at least some of said panels in each course having a first side marginal edge region overlying a second side marginal edge region of an adjacent previously mounted panel in the course; and said upper and lower marginal defining interengageable interlocks for positively securing together overlapping upper and lower marginal edges:

said first marginal edge region of each panel having at least one upwardly directed interlock flange located intermediate the upper and lower edge regions engageable with the second side marginal edge region of an underlying adjacent previously mounted panel in the same course as an incident to upward vertical movement of the panel relative to the adjacent previously mounted panel for positively securing the overlapping side marginal edge regions together when the panels are mounted on the support surface.

2. The wall covering of claim 1 in which said at least one interlock flange of the first side marginal edge region of each panel engages an underside of the second marginal edge region of an underlying adjacent previously mounted panel as an incident to upward movement of the panel relative to the previously mounted panel.

3. The wall covering of claim 1 in which said first side marginal edge region includes a second interlock flange engageable with the second side marginal edge region of an adjacent previously mounted panel as an incident to upward vertical movement of the panel relative to the adjacent previously mounted panel.

4. The wall covering of claim 1 in which said building elements are formed in said body in a plurality of horizontal rows, said second side marginal edge region including a first transverse flange adjacent to and extending laterally outwardly from one row of said building elements, said first transverse flange defining a portion of a front face of said second side marginal edge region and having an end portion which defines a downwardly directed end face, said end portion having an interlock receiving opening for receiving said interlock flange of an overlying first side marginal edge region as an incident to upward vertical movement of the panel during mounting relative to a previously mounted panel, and said second side marginal edge region including a second transverse flange adjacent to and extending laterally outwardly from a bottom row of said building elements, said transverse second flange defining a portion of a front face of said second side marginal edge region, and each panel having an upturned interlock flange adjacent a lower marginal edge region thereof for engaging said transverse second flange as an incident to upward movement of the panel relative to an underlying second marginal edge region of previously mounted panel in the same course.

5. The wall covering of claim 1 in which said building elements are formed in said body portion in a plurality of horizontal rows, said second side marginal edge region including a first transverse flange extending laterally outwardly from a first row of said building elements and a second transverse flange extending laterally outwardly of a second row of said building elements, said first and second transverse flanges each defining a portion of a front face of the second side marginal edge region and having a respective end portion which defines a respective interlock-receiving opening, and said first side marginal edge region of each panel having at least two upwardly turned interlock flanges for respectively engaging the second side marginal edge region openings of an underlying second side marginal edge region as an incidence to upward vertical movement of the panel relative to the previously mounted panel.

6. The wall covering of claim 5 in which said building elements are simulated shake each having a front face and a downwardly directed end face generally perpendicular to the front face of the shake, and said end face portions defined by said first and second transverse flanges of said second side marginal edge region each being recessed with respect to the front face of building element formed in the panel.

7. The wall covering of claim 6 in faces defined by said end portions of said an adjacent which the end first and second transverse flanges each being recessed relative to the end face of an adjacent building element formed in the panel.

8. A wall covering for mounting on a support surface comprising:

a plurality of panels each having a body portion formed with simulated building elements; said panels each having upper and lower marginal edge regions and first and second side marginal edge regions disposed at opposite sides of said panel;

said panels being mountable on said support surface in a plurality of horizontal courses with at least some of said panels in a first horizontal course having a lower marginal edge region overlying an upper marginal edge region of a previously mounted panel in a second course positioned below the first horizontal course and with at least some of said panels having a first side marginal edge region overlying a second side marginal edge region of an adjacent previously mounted panel in the same course;

said lower marginal edge region and said first side marginal edge region of each panel having at least one interlock flange extending upwardly from an under side thereof, and said lower marginal edge region interlock flange and said first side marginal edge region interlock flange being respectively engageable with the underlying upper marginal edge region of the previously mounted panel in the second horizontal course and the underlying second side marginal edge region of the adjacent previously mounted panel in the same course as an incident to upward movement of the panel with respect to said previously mounted panels for positively securing together the overlying upper and lower marginal edge regions and the overlying first and second side marginal edge regions of the panels when mounted on the support surface.

9. The wall covering of claim 8 in which said at least one interlock flange of the first side marginal edge region of each panel engages an underside of the second marginal edge region of an underlying adjacent previously mounted panel as an incident to upward movement of the panel relative to the previously mounted panel.

10. The wall covering of claim 9 in which said second side marginal edge region of at least some of said panels defines a side opening slot into which the interlock flange of an overlying first side marginal edge region is inserted and engageable as an incident to either vertical movement or lateral movement of the panel relative to the adjacent previously mounted panel in the course.

11. The wall covering of claim 8 in which said second marginal edge region of each panel defines an interlock-receiving aperture into which the interlock flange of an overlying first side marginal edge region of a panel is inserted and engaged as an incident to upward vertical movement of the panel relative to the previously mounted panel.

12. The wall covering of claim 8 in which said first side marginal edge region includes a second interlock flange engageable with the second side marginal edge region of an adjacent previously mounted panel as an incident to upward vertical movement of the panel relative to the adjacent previously mounted panel.

13. The wall covering of claim 8 in which said building elements are formed in said body in a plurality of horizontal rows, said second side marginal edge region including a first transverse flange adjacent to and extending laterally outwardly from one row of said building elements, said-first transverse flange defining a portion of a front face of said second side marginal edge region and having an end portion which defines a downwardly directed end face, said end portion having an interlock receiving opening for receiving said interlock flange of an overlying first side marginal edge region as an incident to upward vertical movement of the panel during mounting relative to a previously mounted panel, and said second side marginal edge region including a second transverse flange adjacent to and extending laterally outwardly from a bottom row of said building elements, said transverse second flange defining a portion of a front face of said second side marginal edge region, and each panel having an upturned interlock flange adjacent a lower marginal edge region thereof for engaging said transverse second flange as an incident to upward movement of the panel relative to an underlying second marginal edge region of previously mounted panel in the same course.

14. A wall covering for mounting on a support surface comprising:

a plurality of panels each having a body portion formed with simulated building elements arranged in three horizontal rows;

said panels each having upper and lower marginal edge regions and first and second side marginal edge regions disposed at opposite sides of said panel;

said panels being mountable on said support surface in a plurality of horizontal courses with at least some of said panels in a first horizontal course having a lower marginal edge region overlying an upper marginal edge region of a previously mounted panel in a second course positioned below the first horizontal course and with at least some of said panels having a first side marginal edge region overlying a second side marginal edge region of an adjacent previously mounted panel in the same course;

at least one of said first and second side marginal edge regions of each panel having interlocks adjacent each row of simulated building elements which are engageable with the other of said first and second side marginal edge regions as an incident to upward movement of the first marginal edge region of one panel relative to the underlying second marginal edge region of a previously mounted panel for securing the overlapping first and second side marginal edge regions of the panels together at a location adjacent each row of simulated building elements when mounted on the support surface.

15. The wall covering of claim 14 in which the first side marginal edge region of each-panel has upwardly directed interlock flanges adjacent an end of each row of simulated building elements for engagement with the underlying second marginal edge region of an adjacent previously mounted panel at a location adjacent the end of each row of simulated building elements.

16. The wall covering of claim 15 in which said second side marginal edge regions includes a plurality of openings for receiving a plurality of said, first marginal edge region interlock flanges as an incident to upward movement of the panel relative to a previously mounted panel.

17. The wall covering of claim 14 in which the simulated building elements of the second row extend further in the direction of the second side marginal edge region than the simulated building elements of the first row, and the simulated building elements of the third row extend further in the direction of the building elements of the second row.

18. A wall covering for mounting on a support surface comprising:

a plurality of panels each having a body portion formed with simulated building elements; said panels each having first and second side marginal edge regions;

said panels being mountable on said support surface in a plurality of horizontal courses with at least some of said panels in each course having a first side marginal edge region overlying a second side marginal edge region of an adjacent previously mounted panel in the course;

said second side marginal edge region of each panel defining an interlock receiving aperture; and said first side marginal edge region of each panel having at least one upwardly directed interlock flange engageable with said second marginal edge region interlocks receiving apertures of an underlying adjacent previously mounted panel in the same course as an incident to upward vertical movement of the panel relative to the adjacent previously mounted panel for positively securing the overlapping side marginal edge regions together when the panels are mounted on the support surface.

19. The wall covering of claim 18 in which said second side marginal edge region of each panel includes at least one transverse flange adjacent to and extending laterally to a side of said building elements, said transverse flange defining at least a portion of a front face of said second side marginal edge region, said transverse flange having an end portion defining an end face generally perpendicular to said front face, and said end portion defining said interlock receiving aperture for receiving the interlock flange of an overlying first side marginal edge region of a panel being mounted as an incident to upward movement of the panel relative to the adjacent previously mounted panel.

20. The wall covering of claim 19 in which said second side marginal edge region transverse flange includes a nail mounting aperture in an upper end thereof.

21. The wall covering of claim 19 in which said second side marginal edge region flange aperture is an aperture extending through said end portion.

22. The wall covering of claim 19 in which said second side marginal edge region aperture is a slot opening to a side of the side marginal edge region.

23. A method of installing a wall covering made of a plurality of horizontal courses of individual identically molded panels each formed with simulated building elements and each having upper and lower marginal edge regions and first and second side marginal edge regions disposed at opposite sides of the panel with the lower marginal edge and first side marginal edge region of each panel having at least one interlock flange extending upwardly from an underside thereof comprising the steps of mounting said panels in a plurality of horizontal courses with at least some of the panels in each horizontal course having a lower marginal edge region overlying an upper marginal edge region of a previously mounted panel in a course below and with at least some panels having a first side marginal edge region overlying a second side marginal edge region of an adjacent previously mounted panel in the same course; and engaging the lower marginal edge region interlock flange and the first side marginal interlock flange of a panel being mounted respectively with the underlying upper marginal edge region of a previously mounted panel in the course below and the underlying second side marginal edge region of an adjacent previously mounted panel in the same course as an incident to upward movement of the panel with respect to the previously mounted panels for positively securing together the overlapping upper and lower marginal edge regions and the overlapping first and second marginal edge regions of the panels when mounted on the support surface.

24. The method of claim 23 including engaging the lower marginal edge region with the upper marginal edge region of an underlying panel by engaging the interlock flange of the lower marginal edge region with an outwardly and downwardly directed interlock flange on the upper marginal edge region of the underlying panel, and engaging the first side marginal edge region with the underlying second side marginal edge region by engaging the interlock flange of the first marginal edge region with an opening in the underlying second side marginal edge region of the previously mounted panel.

25. A wall covering for mounting on a support surface comprising:

a plurality of panels each having a body portion formed with simulated building elements; said panels each having upper and lower marginal edge regions and first and second side marginal edge regions;

said panels being mountable on said support surface in a plurality of horizontal courses with at least some of said panels in a first horizontal course having a lower marginal edge region overlying an upper marginal edge region of a previously mounted panel in a second course positioned below the first horizontal course and with at least some of said panels in each course having a first side marginal edge region overlying a second side marginal edge region of an adjacent previously mounted panel in the course;

said second side marginal edge region of at least some of said panels defining a side opening slot; and said first side marginal edge region of each panel having at least one upwardly directed interlock flange that is insertable and engageable with second marginal edge region side opening slot of an underlying adjacent previously mounted panel in the same course as an incident to either upward vertical movement lateral movement of the panel relative to the adjacent previously mounted panel for positively securing the overlapping side marginal edge regions together when the panels are mounted on the support surface.

* * * * *

UNITED STATES PATENT AND TRADEMARK OFFICE

CERTIFICATE OF CORRECTION

PATENT NO. : 6,955,019 B2 
DATED : October 18, 2005
INVENTOR(S) : Terence James Donlin, Francesco Guzzo and Russell Hampton It is certified that error appears in the above-identified patent and that said Letters Patent is hereby corrected as shown below:

Title page,
Item [75], Inventors, add:
-- Russell Hampton, Royal Palm Beach, FL (US) --.

Signed and Sealed this

Twenty-first Day of February, 2006

JON W. DUDAS
*Director of the United States Patent and Trademark Office*